United States Patent [19]

Smith

[11] Patent Number: 4,922,808

[45] Date of Patent: May 8, 1990

[54] RADON AND OTHER GAS VENTILATOR

[76] Inventor: Stephen D. Smith, P.O. Box 106, Sedalia, Colo. 80135

[21] Appl. No.: 311,714

[22] Filed: Feb. 16, 1989

[51] Int. Cl.[5] ..... F24F 11/00; F24F 12/00

[52] U.S. Cl. ..... 98/42.06; 98/42.04; 98/119; 98/42.12; 34/90; 165/909

[58] Field of Search ..... 34/90, 235; 98/42.02, 98/42.04, 42.06, 42.12, 119, DIG. 7; 165/901, 909, 4

[56] References Cited

U.S. PATENT DOCUMENTS

| | | | |
|---|---|---|---|
| 980,471 | 1/1911 | Zenke | 98/42.06 |
| 2,311,948 | 2/1943 | Lagodzinski | 34/90 |
| 2,733,668 | 2/1956 | Pfetzing | 98/42.06 X |
| 3,606,593 | 9/1971 | Steiner | 98/42.07 |
| 3,673,701 | 7/1972 | Albertson | 34/90 |
| 4,034,482 | 7/1977 | Briscoe | 34/90 X |
| 4,251,026 | 2/1981 | Siegel et al. | 98/42.04 |
| 4,543,941 | 10/1985 | Newell | 126/312 |
| 4,681,024 | 7/1987 | Ivey | 98/42.07 |

FOREIGN PATENT DOCUMENTS

| | | | |
|---|---|---|---|
| 77636 | 6/1981 | Japan | 98/42.04 |

OTHER PUBLICATIONS

"Radon Reduction Techniques for Detached Houses", *Technical Guidance,* EPA/625/5-86/019, U.S. Environmental Protection Agency, Jun. 1986.

*Primary Examiner*—Harold Joyce

[57] ABSTRACT

An effective radon ventilator which adapts to laundry dryer vents. The unit vents radon gas from houses at the point of greatest concentration, the basement or ground level, as well as venting other objectionable fumes. The ventilator houses a fan and a flow damper to vent both airborne radon gas/fumes and laundry dryer vapors. A heat transfer device enables energy efficient operation.

3 Claims, 2 Drawing Sheets

RADON AND OTHER GAS VENTILATOR

BACKGROUND OF THE INVENTION

The present invention relates to vent devices which use existing ductwork for reducing the concentration of radon gas and similar undesirable gases in houses and apartments.

Heretofore kitchen, bathroom and other vent fans have been used to vent radon gas from buildings through existing ductwork. The disadvantage of these devices is that they do not act upon radon until after it has permeated the occupancy areas of the house and, therefore, is already a health threat. A device of this type is disclosed in U.S. Pat. No. 3,606,593 and in U.S. Pat. No. 4,681,024. Vents which connect to furnace chimneys must withstand the high temperatures of flue gas, require an experienced installer and may cause poisonous flue gases to leak into the building if not properly maintained. Such a device is disclosed in U.S. Pat. No. 4,543,941.

Additional devices are known in the art. In the known devices sealants are applied to cracks in the building foundation to prevent radon gas from entering. The disadvantage of the above devices is that the sealant is difficult to apply and requires removal of existing floor coverings. Sealants can not be applied in subfreezing temperatures. Sealants rely upon an air tight barrier which has been known to cause the undesirable side effect of increasing the concentrations of other, sometimes toxic, indoor fumes, gases and odors.

An additional known device aims to reduce the concentration of radon below the foundation and thus minimize any inflow to the building. These devices consist of a perforated vent pipe or duct installed beneath the foundation and extending beyond the building walls. Radon gas flows through the path of least resistance from the ground into the pipe and beyond the building walls where it dissipates harmlessly.

The disadvantage of the above device is that it is difficult to retrofit to existing structures. It relys upon the presence of a permeable sub-foundation such as gravel to reliably vent each area of the foundation. This device requires materials, preparation and installation in addition to that which is normally required for a new building as otherwise constructed.

SUMMARY OF THE INVENTION

Accordingly, it is an object of the present invention to provide a novel device for venting radon and other gases from houses, which avoids the disadvantages of the prior art and which is energy efficient.

One feature of the present invention resides, briefly stated, in a radon gas ventilator which utilizes existing ductwork and house wall ventilation openings, in the case of existing houses, and such ductwork and wall openings as would be otherwise provided in new houses. This is achieved with a ventilator which can be inserted in series into the duct which connects a conventional, heated, fan circulated laundry dryer to a house ventilation opening.

The ventilator duct body having a generally circular port for connecting to a laundry dryer vapor and lint exhaust port, one or more ports being provided for a device such as a fan to produce a differential pressure to exhaust airborne radon gas and radon progeny and a generally circular port through which the radon gas and alternately laundry dryer vapors admitted through the other ports can flow to the house wall ventilation opening provided for use with the laundry dryer.

A further object is to exhaust radon gas from a house before it has permeated the primary living quarters of the building. This can also be achieved by locating the ventilator in a laundry dryer vent duct which is normally located in a house basement or ground floor laundry room where radon gas concentrations are highest and where human contact is least.

Readers will find further objects and advantages of the invention from a consideration of the ensuing description and the accompanying drawings.

DRAWING

DRAWING DESCRIPTION

Figure 1:
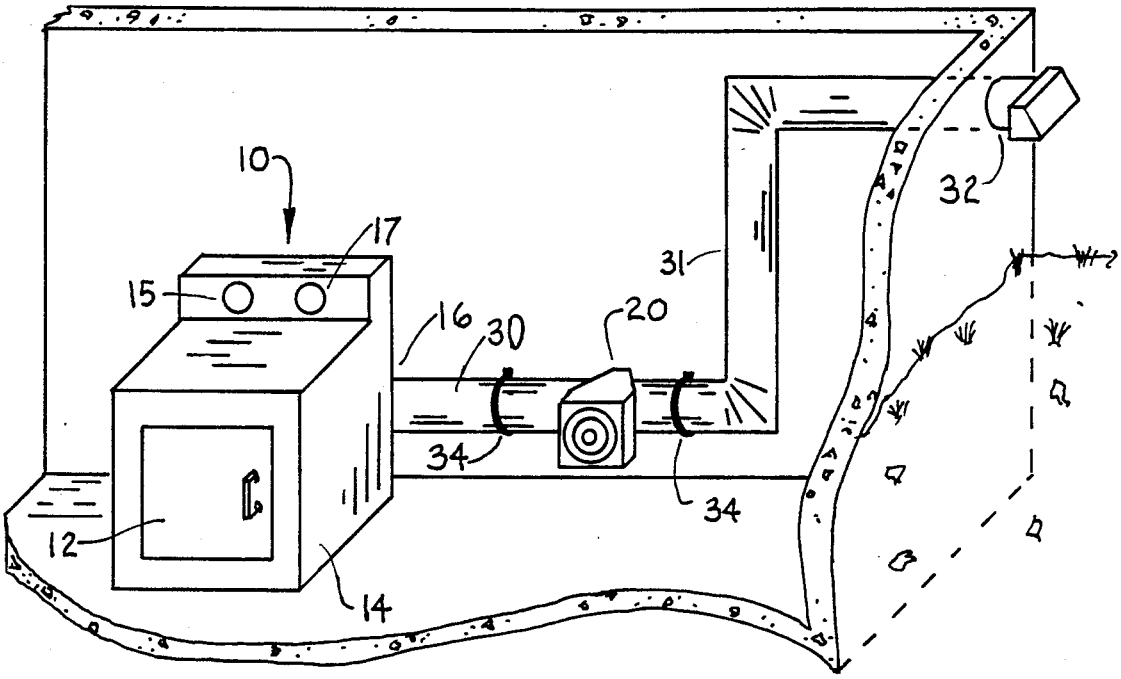
FIG. 1 is a perspective view of the radon ventilator installed in a laundry dryer vapors and lint exhaust duct.

FIG. 1 shows a conventional laundry dryer 10 having a door 12 through which wet laundry and clothing is placed into a chamber (not shown). The dryer cabinet 14 contains the chamber, an electric or gas burning heat source and a fan for circulating heated air through the chamber to a vapor and lint exhaust port 16. Temperature control 15 and cycle timer 17 provide a wide range of dryer operation to effectively dry small or large laundry loads.

In a conventional home or apartment installation the laundry dryer vapor and lint exhaust port 16 is connected by circular ducts 31 to the house wall ventilation opening 32 which penetrates the wall to the outside atmosphere. In this way the dryer exhaust vapor and lint are transported out of the house to the outdoors.

Figure 2:
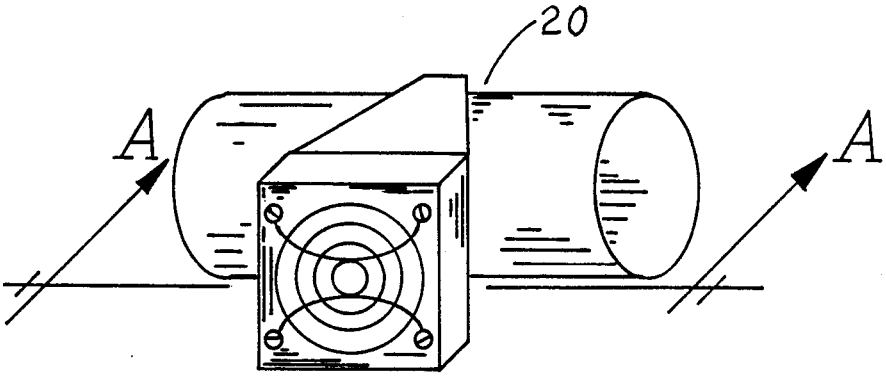
FIG. 2 is an enlarged perspective of the radon ventilator with section line A—A.
Figure 3:
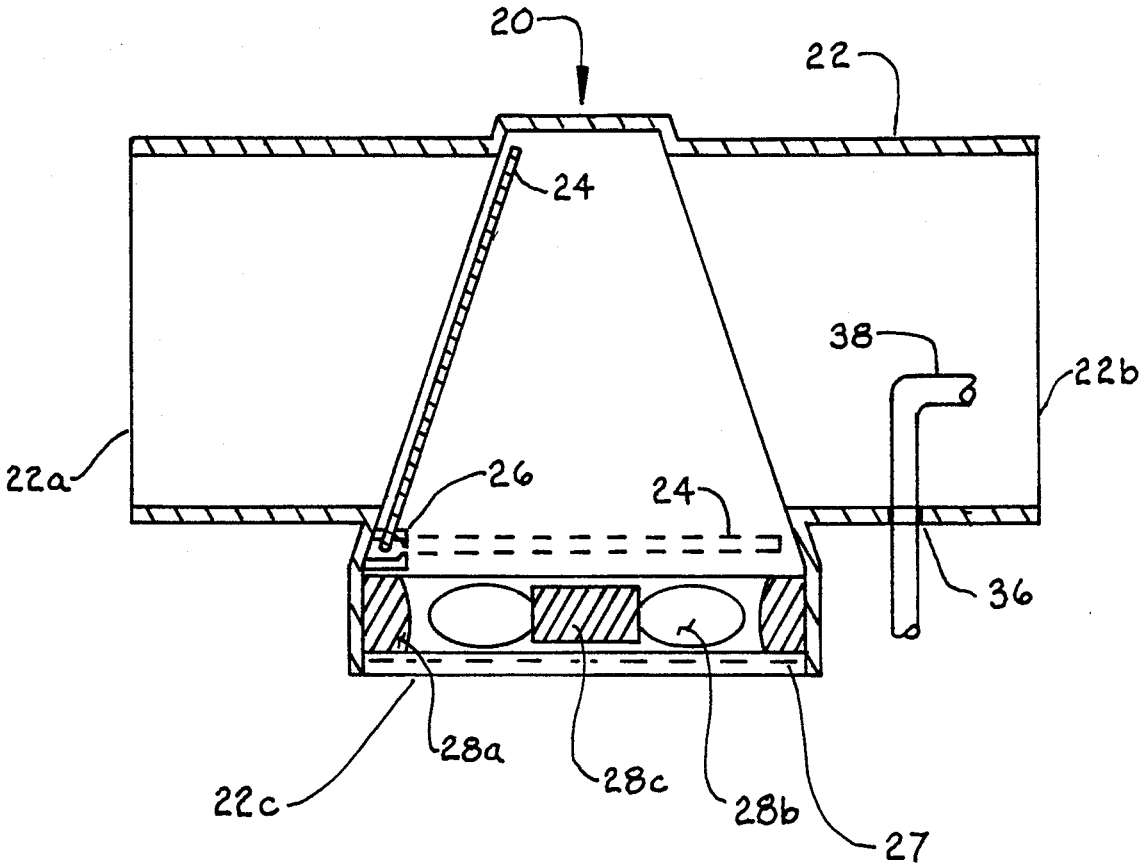
FIG. 3 is a sectional view of the radon ventilator along section line A—A indicated in FIG. 2.

In order to vent radon gas, radon progeny (radon decay products) and other objectionable gases from a house basement or laundry room my invention utilizes a three ported ventilator 20 having two generally circular ports **22*a* and 22*b* which are connected in series between two sections of the laundry dryer ducts 30 and 31 as shown in FIGS. 1 to 3. The ventilator vapor inlet port 22*a* is connected to the laundry dryer vapor and lint exhaust port 16 by way of the duct 30. The ventilator outlet port 22*b* is connected to the house wall ventilation opening 32 by way of duct 31**.

The ducts 30 and 31 are held in place on the ventilator ports **22*a* and 22*b* by plastic or metal clamps 34 or by other fastening means. The ventilator body 22 is made of a rigid and heat resistant material such as thermoplastic, thermosetting plastic, sheet metal or other suitable material and it has a thin walled construction to form a hollow body having three ports in fluid communication. The third ventilator body port constitutes the radon inlet port 22*c* which is formed with its axis substantially perpendicular to the vapor inlet port 22*a***.

Mounted within the ventilator duct body 22, between the vapor inlet port **22*a* and the radon inlet port 22*c*, is a freely pivoting, substantially thin plate flow damper 24. The damper 24 pivots on its hinges 26 to meet and close the radon inlet port 22*c* from the remainder of the ventilator body. With the damper in this position there is formed within the ventilator duct body 22 a single, unobstructed flow path from the vapor inlet port 22*a* to the outlet port 22*b***.

The ventilator duct body 22 is configured so that the junction of the vapor inlet port 22*a* at the duct body 22 is substantially planar. This substantially planar junction forms a seating surface for the pivoting damper 24 to fit flush against and to close, thereby preventing fluid communication between the vapor inlet port 22*a* and the remainder of the ventilator duct body 22.

In this position the damper together with the ventilator duct body 22 form a flow path from the radon inlet port 22*c* to the outlet port 22*b*.

For the damper 24 to alternately seal either the vapor inlet port 22*a* or the radon inlet port 22*c* it must be positioned so that the damper 24 independently contacts the interior seating surface of each port.

A radon exhaust fan assembly including a frame and mount 28*a*, fan blade 28*b*, fan motor 28*c* and grille 27 is mounted to the ventilator duct body 22 at the exterior of the radon inlet port 22*c*.

In operation the radon exhaust fan forces radon laden room air past the grille 27 against the freely pivoting damper 24 with sufficient momentum to cause it to pivot away from the radon inlet port 22*c* and to seat against the interior surfaces of the vapor inlet port 22*a*. A radon exhaust passage is thereby formed through the ventilator 20 into the duct 31 and outdoors through the wall ventilation opening 32. Backflow of the exhaust radon through duct 30, into the dryer 10 and back into the room is prevented by the seating action of the damper 24 against the interior surface of the vapor inlet port 22*a*.

When the laundry dryer is on, the momentum of the dryer vapors and lint exhaust forces the damper 24 away from the vapors inlet port 22*a* and to seat against the interior surfaces of the radon inlet port 22*c*. An unobstructed vapors and lint passage is thereby formed through the ventilator 20 into the duct 31 and outdoors through the wall ventilation opening 32.

Details of a second embodiment of the invention are shown in FIG. 3. The radon laden air exhausted from the basement or laundry room by the radon ventilator is normally replaced by air which flows from the outdoors through makeup air ducts generally found in houses and around doors, windows and through bathroom vents. In houses which are very air tight a separate air replenishment tube 38 provides a path from the outside atmosphere through the wall ventilation opening 32, through the duct connecting the ventilator outlet port 22*b* to the wall ventilator opening 32 and through the ventilator body at the hole 36 which is located so that the tube 38 does not impede the movement of the freely pivoting damper 24. The tube 38 extends a distance from the wall ventilator opening 32 along the exterior of the house so as not to re-entrain the radon exhausted from the house. The tube extends through ventilator body hole 36 a distance away from the ventilator so that replenishment air drawn into the house from the outdoor atmosphere is not immediately vented back through the radon exhaust fan.

In operation, whenever the radon exhaust fan or the laundry dryer exhaust forms a draft, atmospheric outdoors air flows through the air replenishment tube 38 into the house to equalize pressure within and without the house.

A simple modification of this embodiment forms a new, third embodiment wherein a portion of the air replenishment tube 38 is made of a heat conductive material which forms a heat transfer surface between the radon laden exhaust air and the replenishment air. In operation, exhausted radon laden air transfers heat to the counterflowing, replenishment air present within the air replenishment tube 38 flowing into the house from the outdoors.

Thus the reader will see that the present invention provides an improved method to limit exposure to radon and other harmful airborne gases. The deleterious effects of such exposure are thus avoided or reduced.

While my above description contains may specificities, these should not be construed as limitations on the scope of the invention, but rather, as an exemplification of several preferred embodiments of these. Many other variations are possible. For example, the three ports of the ventilator body need not be arranged with the radon inlet port perpendicular to either of the remaining two ports.

I claim:

1. Apparatus for venting radon, radon progeny and other objectionable gases from a house basement comprising in combination:

(a) a laundry dryer of the type having a door through which laundry is placed into a chamber, a heat source and a fan for directing air from said heat source through said chamber to a vapor and lint exhaust port;

(b) a house wall ventilation opening provided for use with said laundry dryer vapor and lint exhaust port;

(c) a radon ventilator comprising;

(1) a thin walled ventilator duct body of suitably rigid and heat resistant material having a substantially circular vapor inlet port, a substantially circular outlet port and a radon inlet port arranged with its axis substantially perpendicular to the axis of said vapor inlet port such that the three ports are in fluid communication with one another through the interior of said ventilator body, the ventilator body together with said vapor inlet and said radon inlet ports being configured so that the individual, interior body-to-port juctions are substantially planar;

(2) a freely pivoting, hinge mounted, thin plate flow damper within said ventilator body, said hinges located such that the axis of the hinges is substantially parallel to both the plane defined by the interior periphery of said vapor inlet port and the plane defined by the interior periphery of said radon inlet port, said hinges and said damper further located and sized such that pivotal movement of said damper away from the vapor inlet port causes said damper to fit flush against the interior periphery of the radon inlet port thereby closing it and such that opposite pivotal motion of said damper causes it to meet and fit flush with the interior periphery of the vapor inlet port thereby closing it;

(3) a driven exhaust fan suitably joined with fastening means to the exterior periphery of the radon inlet port external to the high temperature and lint laden interior passages of said ventilator body and separate from the downstream flow paths of the remaining ports of said ventilator body, said exhaust fan sized and oriented to force radon laden room air, radon progeny and objectionable gases from without said ventilator body against said freely pivoting flow damper with sufficient momentum to pivot the damper so as to open the radon inlet port and to close the vapor inlet port thereby forming a passage from the radon inlet port through the ventilator body to the outlet port, and (d) duct means connecting said laundry dryer vapor and lint exhaust port to the vapor inlet port of the ventilator body wherein the momentum of said vapors acting upon said freely pivoting damper causes said damper to pivot away from the vapor inlet port and to close the radon inlet port thereby forming a passage from the vapor inlet port to the outlet port, and duct means for communicating the outlet port of the ventilator body with said house wall ventilation opening whereby basement radon gas and laundry dryer vapors are separately vented to the outdoors using the same wall vent opening and duct means.

2. The combination of claim 1 further including:

(a) said ventilator having a hole penetrating said ventilator body in proximity of said outlet port, said hole located apart from the surfaces swept by said pivoting damper such that a protrusion of tubing through said hole does not impede movement of said damper, (b) a length of tubing extending a distance from the exterior of and into said house ventilation opening through said duct means, said tubing extending into said ventilator body outlet port and further extending through said hole penetrating the ventilator body, said tubing further extending a distance from the body into the house whereby a continuous path is formed for communicating the outside atmosphere and the interior of said house wall whereby exhausted radon laden air is replaced with fresh atmospheric air.

3. The combination of claim 2 wherein a portion of said tubing extending through said duct means and into said ventilator is made of a heat conductive material forming a heat transfer surface between the exhausted radon laden air and the replacement atmospheric air whereby heat is transfered from the exhausted radon laden air to the fresh replacement air.

* * * * *